United States Patent [19]

Gulla et al.

[11] Patent Number: 4,634,468

[45] Date of Patent: Jan. 6, 1987

[54] CATALYTIC METAL OF REDUCED PARTICLE SIZE

[75] Inventors: Michael Gulla, Sherborn; Oleh B. Dutkewych, Harvard; John J. Bladon, Wayland, all of Mass.

[73] Assignee: Shipley Company Inc., Newton, Mass.

[21] Appl. No.: 607,649

[22] Filed: May 7, 1984

[51] Int. Cl.[4] ..... C23C 3/02

[52] U.S. Cl. ..... 106/1.11; 427/304; 427/305; 427/306; 524/440

[58] Field of Search ..... 106/1.05, 1.11; 524/440

[56] References Cited

U.S. PATENT DOCUMENTS

| | | | |
|---|---|---|---|
| 1,444,257 | 2/1923 | Lilienfeld | 252/313 R |
| 3,958,048 | 5/1976 | Donovan et al. | 427/304 |
| 4,004,051 | 1/1977 | Kadison et al. | 427/304 |
| 4,252,677 | 2/1981 | Smith | 524/440 |

OTHER PUBLICATIONS

Hirai, Jour. of Macromolecular Science and Chem., A13 (5), pp. 633–649, 1979.

*Primary Examiner*—Lorenzo B. Hayes
*Attorney, Agent, or Firm*—Robert L. Goldberg

[57] ABSTRACT

A catalytic adsorbate suspended in an aqueous solution comprising reduced catalytic metal on an organic suspending agent where the reduced catalytic metal has a maximum dimension not exceeding 500 angstroms. The catalytic adsorbate is useful for the electroless metal deposition of substrates that are non-catalytic to electroless metal deposition.

28 Claims, No Drawings

CATALYTIC METAL OF REDUCED PARTICLE SIZE

BACKGROUND OF THE INVENTION

1. Introduction

This invention relates to reduced catalytic metals having a mean particle size not exceeding about 500 Angstroms and more particularly, to adsorbable catalytic compositions useful for electroless metal deposition, to methods for making said catalytic adsorbates and to methods of using the same.

2. Description of the Prior Art

Electroless metal deposition is the chemical deposition of a metal or mixture of metals over a catalytic surface by chemical reduction. If a substrate to be plated is not catalytic to metal deposition, the substrate is catalyzed prior to deposition by treatment with a suitable catalyst that renders the surface catalytic to electroless metal deposition.

The catalyst in most common commercial use today comprises the reaction product of a molar excess of stannous tin with palladium ions in hydrochloric acid solution. The reaction product is believed to be a tin-palladium colloid. It is believed that the oxidized tin forms a protective colloid for the palladium and the excess stannous acts as an antioxidant. Colloidal tin-palladium catalysts were first described in U.S. Pat. No. 3,011,920 incorporated herein by reference.

An improvement in colloidal tin-palladium catalysts is disclosed in U.S. Pat. No. 3,904,792 incorporated herein by reference. In this patent, in order to provide catalysts less acidic than those disclosed in the aforesaid U.S. Pat. No. 3,011,920, a portion of the hydrocholoric acid is replaced by a soluble salt of the acid resulting in a more stable catalyst having a pH that can approach about 3.5, but not exceed this value. The catalysts of this patent have also encountered significant commercial success.

The colloidal tin-palladium catalysts have been used in significant quantity since their introduction in about 1958 without change other than the substitution of the salt of the hydrochloric acid for the acid as described above, though during this period and especially since about 1970, considerable efforts have been made to find new and better catalysts. For example, because of the high cost of palladium, considerable effort has been directed toward the development of a non-noble metal catalyst, particularly towards the development of a colloidal copper catalyst. Though functional catalysts from copper are now reported to be in commercial use, it is believed that this use is limited as such catalysts are subject to oxidative attack resulting in loss of stability and/or functionality. In addition, such catalysts are believed to require a high concentration of copper to compensate for the limited catalytic activity of copper relative to palladium. In addition, such catalysts require a highly active copper plating solution of limited stability to compensate for the limited activity of copper as a catalyst.

Another direction that catalyst research has taken is towards the development of a tin free palladium catalyst since the stannous chloride used to reduce the palladium is costly and the oxidized tin requires a separate step of acceleration. Tin free noble metal catalysts, believed to be colloidal, are disclosed in U.S. Pat. No. 4,004,051, also incorporated herein by reference. It is believed that the catalysts of U.S. Pat. No. 4,004,051 have not been used in commerce for any purposes. For example, they are unsuitable for the manufacture of printed circuit boards and multi-layer printed circuits or for plating on plastics because the catalysts are not sufficiently active nor reliable for through-hole plating. Furthermore, these catalysts typically become progressively less active upon standing, and this change in activity renders such catalysts unreliable and impractical for commercial use. One test of the ability of a catalyst to cover a substrate with electroless metal is known as the backlight test (more fully described below). In this test, voids in a copper deposit over a catalyzed surface of a through-hole in a printed circuit board are revealed, if present. It has been found that many of the freshly prepared catalysts of the above referenced patent are incapable of passing the backlight test. With respect to those freshly prepared catalysts tested that were able to meet the requirements of this test, after standing for several days, catalytic activity had decreased and, to the extent that the catalysts were still active, they failed the backlight test.

Though not wishing to bound by theory, it is believed that it is one discovery of the invention described herein that the catalysts of U.S. Pat. No. 4,004,051 are unsuitable for commercial use because the active species comprising the catalysts, believed to be colloidal catalytic metal, are of a particle size too large for adequate colloidal stability. In addition, it is believed that the particles vary considerably with respect to particle size distribution. For example, the patent describes the particles as having a reduced noble metal particle size not exceeding above 0.2 microns (2000 Angstroms). The lower limit for particle size is not given, but based upon the poor performance of these catalysts, it is believed that very small particle size, i.e. less than 500 Angstroms could not be obtained by the methods used to produce the catalysts of said patent. Moreover, it is believed that a catalyst having a reduced catalytic metal particle with a mean particle size approaching 2000 Angstroms will not have sufficient stability for extended commercial use.

Noble metal colloids of small particle size—i.e., 500 Angstroms or less, are believed to be known and used in arts other than in the art of electroless metal plating, but it is believed that such colloids are formed in a non-aqueous solution such as in hydrocarbon solution. Typical of such colloids are disclosed, for example, in U.S. Pat. Nos. 4,059,541 and 4,252,677, both incorporated herein by reference. The inert solvent is believed to be in part responsible for forming and maintaining a colloid of small particle size. However, the inert solvent is expensive to use, many of such solvents would inactivate the catalyst, others might attack plastic substrates and in general, a hydrocarbon solvent would be viewed as undesirable for commercial use. Moreover, to be used as a catalyst for electroless metal deposition, the reduced metal colloid would have to be adsorbed and held on a surface to be plated. It is not known that the reduced noble metal colloids of the aforesaid patent would adsorb onto a surface.

DEFINITIONS

The term "catalytic metal" as used herein includes those noble metals known to catalyze electroless metal deposition but excludes those non-noble metals used as electroless catalysts such as copper.

The term "catalytic adsorbate" as used herein means a reduced catalytic metal firmly associated with an organic suspending agent which suspending agent is adsorbable onto a surface.

SUMMARY OF THE INVENTION

The subject invention is for a catalytic adsorbate in aqueous solution of a reduced catalytic metal firmly associated with or fixed onto an organic suspending agent. Though not wishing to be bound by theory, it is believed that the association of the reduced metal with the suspending agent comprises adsorption of the metal onto the suspending agent. The organic suspending agent serves as a protective colloid. The average or mean maximum dimension of the reduced catalytic metal particles adsorbed onto the organic suspending agent are relatively uniform. The reduced catalytic metal particles have an average maximum dimension that do not exceed 500 Angstroms.

The invention is also directed to methods of making a catalytic adsorbate utilizing a combination of steps believed to be novel, methods of using the catalytic adsorbates, products made therefrom, replenishment of depleted catalytic adsorbate solutions and other improvements as will be described below. In the preferred embodiment of the invention, the adsorbates are used as catalytic adsorbates in processes for electroless metal deposition.

The catalytic adsorbates of this invention are formed in a controlled manner whereby there is a controlled generation of nuclei in a single burst which then grow until the reaction is deliberately completed when the particles reach a desired size. In this way, all of the particles are formed within a relatively short time span and are permitted to grow to a point where stable particles of a desired size are obtained. Thereafter, agglomeration is inhibited resulting in particles of small size and limited size distribution.

A general procedure for the formation of the catalytic adsorbates of the invention comprises dissolution of a salt of the catalytic metal in aqueous solution followed by reduction of the dissolved metal with a suitable reducing agent under controlled conditions to accomplish the results described above, the reduction taking place in the presence of a suitable organic suspending agent.

Following the procedures of the invention, there results a catalytic adsorbate that is a highly active electroless metal deposition catalyst that remains functional during prolonged use or prolonged standing because of exceptional stability and catalytic activity. The high activity of the catalyst also permits use of a more stable plating solution which is highly advantageous as it is known in the art that such plating solutions are subject to spontaneous decomposition.

The catalysts most commonly used in commerce for throughhole plating in the manufacture of printed circuit boards are the tin-palladium catalysts described above. However, the catalysts of this invention are improved over tin-palladium catalysts in many ways. For example, the catalysts of this invention, compared to the tin-palladium catalysts, (a) are free of tin in the catalyst bath; (b) do not require a step of acceleration and therefore fewer rinsing steps are required between the catalyst bath and the electroless metal plating bath; (c) are only mildly acidic resulting in no observable attack on copper oxide coated innerlayers as are required for the manufacture of multi-layer boards; (d) are free of hydrocholoric acid fumes; (e) require less stringent waste treatment procedures; (f) avoid degradation of the surface insulation resistance of the plastic substrates due to the presence of residual adsorbed catalyst; (g) permit plating of substrates that are attacked by strong acid solutions; (h) provide a longer potlife (stability against oxidation) without the requirement of replenishment; (i) are significantly lower in cost to make and use; (j) can be used in higher concentrations, if desired, because there is no build up of tin salts; and (k) can be used in a spray mode without excessive requirements for replenishment.

In addition to the aforesaid, the catalysts of this invention may be dried and reconstituted by simply mixing the same in a suitable liquid vehicle. Other advantages of the invention will become apparent from the description which follows.

DESCRIPTION OF THE PREFERRED EMBODIMENTS

In accordance with the invention, the catalytic adsorbate comprises a reduced catalytic metal firmly associated with an organic suspending agent. The term "associated with" means that the reduced metal is fixed onto the suspending agent, but the means by which it is fixed to the supending agent is not fully understood though it is believed that the reduced particles are adsorbed onto the suspending agent.

The reduced metal is believed to be colloidal in nature. However, the colloidal nature of the reduced metal is based upon theoretical considerations and this theory should not be construed as limiting the invention to colloidal materials. Rather, the reduced catalytic metal is defined as the reaction product formed by the controlled reduction of the catalytic metal in accordance with the teachings herein.

Throughout this specification, reference will be made to the average dimension of the reduced catalytic metal. If the reduced catalytic metal is a spherical colloid, the average dimension is the average diameter of the particle. If the reduced catalytic metal is a non-spherical particle, the average dimension will refer to the maximum dimension. If the reduced catalytic metal is other than a colloid, the average dimension will refer to the reduced species and will not exceed the maximum permissible average dimensions set forth herein.

The adsorbates of the invention are formed under controlled reaction conditions whereby there is the sudden creation of nuclei within a relatively short time span followed by controlled growth of these nuclei until, after a given time interval, the reduction is driven to completion within a short time span. The dissolved catalytic metal is reduced with one or more suitable reducing agents in the presence of an organic suspending agent. The catalytic metal used to form the catalyst is an acid soluble salt of any of those catalytic metals known to exhibit catalytic properties for electroless plating such as those disclosed in the aforesaid U.S. Pat. No. 3,011,920. Such metals include members of the platinum family including mixtures of platinun family metals, but exclude non-noble metals used in the prior art such as copper. Palladium is known to be the most desirable of the catalytic metals for the activation of substrates for electroless metal plating and constitutes the most preferred embodiment of this invention.

The particular salt of the catalytic metal used to form the catalyst is one that is soluble in the aqueous medium in which the catalytic adsorbate is formed. The catalyst can be formed from a single catalytic metal or a mixture of several of such metals. In the preferred embodiment of the invention, the chloride salt of the palladium is dissolved in an aqueous medium acidified with hydrochloric acid to form a solution of the catalytic metal. A lesser preferred, though useful salt, is the sulfate.

The reducing agent used to reduce the catalytic metal is any of those reducing agents capable of reducing dissolved catalytic metal to a reduced catalytic form without formation of by-products that would interfere with catalysis. Reducing agents of the type disclosed in the aforesaid U.S. Pat. No. 4,004,051 are suitable and include, for example, dimethylamine borane, sodium borohydride, ascorbic acid (including iso-ascorbic acid), sodium hypophosphite, hydrazine hydrate, formic acid, and formaldehyde. Of the reducing agents listed, the reducing agents considered "weak reducing agents" exemplified by ascorbic acid, formic acid and formaldehyde are preferred, ascorbic acid and iso-ascorbic acid being most preferred. The reducing agents considered "strong reducing agents" are lesser preferred. Weak reducing agents are preferred to strong reducing agents because their use is easier to control in carrying out the controlled reduction in accordance with the procedures set forth herein. With the strong reducing agents, reduction takes place at a rate whereby the particle formed may be too large for purposes set forth herein. However, it should be realized that a strong reducing agent can be made to perform as a weak reducing agent by dilution, cooling, etc.

The reduction of the dissolved catalytic metal takes place in an aqueous solution in the presence of the suspending agent. The suspending agent is a solution soluble or dispersible organic material capable of holding the reduced catalytic metal in suspension while preventing the formation of large aggregates. Suitable suspending agents are known in the art. Several are disclosed in the aforesaid U.S. Pat. No. 4,004,051, though many of the suspending agents disclosed in said patent are unsuitable and other suspending agents, not disclosed in said patent, are particularly useful and are believed not to have been used in the prior art as suspending agents for catalytic metals in the art of electroless metal deposition.

The suspending agent of the invention is most preferably a water soluble or dispersible polymer such as an alkyl or hydroxyalkyl cellulose, polyacrylamides, poly (acrylic acids) and their homologs, polyethylene glycol, polyvinyl alcohol, polyvinyl pyrrolidone, etc. These materials may be used alone or in combination with each other. The suspending agent may also be a surfactant with a polymeric adduct.

Of the aforesaid polymers, most preferred are nitrogen containing polymers such as polyvinyl pyrrolidone as these polymers provides catalytic adsorbates significantly more stable and more active during extended use than the catalytic adsorbates formed using the other polymers identified above. Though not wishing to be bound by theory, it is believed that these improved results are obtained because of the ability of nitrogen containing polymers to bond or complex with the catalytic metal ions, especially palladium ions, resulting in a more even distribution of the catalytic metal throughout the polymer with the catalytic metal ions more firmly bonded to the polymer during in situ reduction. It is believed that other polymers capable of complexing the catalytic metal will likewise show improved results.

With respect to the use of polyethylene glycol as a suitable suspending agent, it should be noted that in the aforesaid U.S. Pat. No. 4,004,051, there is a teaching that that the polyethylene gylcol is unsuitable as a suspending agent by itself. It is believed that its suitability for use as a suspending agent in accordance with the subject invention is due to the improved and novel method of manufacture of catalytic adsorbates as described herein.

Water soluble organic surfactants can be used as suspending agents in accordance with the subject invention. The preferred surfactants are nitrogen containing cationic surfactants. However, the use of surfactants is lesser preferred as the catalytic adsorbates formed are unstable and tend to become inactive during prolonged use unless the surfactant has a polymer adduct attached. Suitable surfactants that may be used include polyoxyethylene (20) sorbitan monooleate and stearamidopropyl dimethyl-$\beta$-hydroxy-ethyl ammonium nitrate.

The reduction of the catalytic metal preferably takee place in an aqueous, weakly acidic solution. Many acids may be used provided the anion of the acid is non-interfering with reduction and subsequent catalytic activity. The chloride salt of the catalytic metal used in conjunction with hydrochloric acid is particularly suitable unless the acid is used in excessive amounts.

Conditions for the formation of the catalytic adsorbate of the invention are believed to be novel. The conditions are regulated in such a way that the maximum number of nuclei form over a short duration of time. In this way, all of the nuclei are formed during this short interval, grow at about the same rate, and result in a more uniform particle size with a greater surface area to volume ratio of catalytic particles. In the preferred embodiment of the invention, after an interval of controlled growth of the nuclei, the reduction is driven to essential completion by addition of a reducing, agent which completes the reaction and enhances stability against precipitation. By this procedure, there is formed a reduced catalytic species having a uniform particle size of limited particle size distribution and having a maximum average dimension not exceeding 500 Angstroms. In accordance with the preferred embodiment of the invention, the reaction is driven to completion when the particle size of the reduced catalytic metal has an average maximum dimension not exceeding 300 Angstroms and most preferably, when the average dimension varies between that which is the smallest possible to about 200 Angstroms. Electron microscopy has revealed that in accordance with the process of the invention, reduced catalytic particles may be formed having a size as small as 50 Angstroms.

There are multiple reaction conditions that favor the formation of a reduced catalytic metal having a maximum dimension not exceeding 500 Angstroms. These controls include the use of a weak, rather than a strong reducing agent (with respect to the metal being reduced); a rapid addition of the reducing agent to a solution of the dissolved catalytic metal ions; reduction of the dissolved catalytic metal ions at a decreased temperature; reduction of the dissolved catalytic metal ions in a solution where the concentration of the dissolved ions are relatively high and in connection with such a high concentration, close control of the pH of the solution by addition of an alkali metal hydroxide. If careful control of solution pH is not maintained, a murky solution or a precipitate is formed. In the most preferred embodiment of the invention, all of the controls identified above are used though it should be understood that useful products may be obtained with only one or more of the above identified controls dependent upon the materials and conditions used.

The description that follows is the most preferred method for formation of catalytic adsorbates in accordance with the invention.

The first step in the formation of the catalytic adsorbate is to completely dissolve the catalytic metal salt in solution. This is preferably accomplished by dissolving a salt of the catalytic metal in acidic aqueous solution, preferably in large concentration relative to the final concentration of the catalytic metal in the catalyst formulation. A complexing acid having an anion e.g. chloride, common to the anion of the catalytic metal salt may be used to increase solubility. The preferred concentration of catalytic metal salt in solution may vary from about 500 to 10,000 parts per million parts of solution and more preferably, from about 1,000 to about 5,000 parts per million parts. Using palladium as the preferred catalytic metal, the dissolution of anhydrous palladium chloride in about 1.5N hydrochloric acid is effective for quickly solubilizing the salt. The pH of the solution following dissolution will be well below 1.

Following dissolution of the catalytic metal salt, the solution is diluted by admixing an aliquot thereof with water whereby the concentration of the catalytic metal is reduced to between about 10 and 2000 parts per million parts (ppm) of total solution (ppm) and preferably to a concentration varying between 300 and 1500 ppm.

Following formation of the catalytic metal solution and its dilution, the suspending agent is added to the solution and dissolved or dispersed with solution agitation. It is difficult to set forth a precise range of concentration for the suspending agent as its concentration may vary within wide limits, dependent upon several variables, especially the specific combination of suspending agent and reducing agent used, as well as the concentration of the catalytic metal in solution. Higher concentrations of suspending agent appear to be required when using stronger reducing agents. Recognizing that selection of an optimum range for any given set of materials and conditions will require routine experimentation, a broad range of concentration for the suspending agent comprises from about 10 to 100,000 parts of suspending agent per million parts of solution and preferably, from about 20 to 10,000 parts suspending agent per million parts of solution. It should be noted that if the concentration of the suspending agent is insufficient, the catalyst will not be adequately stable. Alternatively, if the concentration is excessive, the catalyst might not be functional. Consequently, the experimentation required to find the optimum concentration of suspending agent will take functionality and stability into consideration and attempt to balance these two properties.

For reasons not fully understood, when the concentration of the catalytic metal salt is 500 ppm or more, it is desirable to adjust solution pH within a narrow range. This range varies dependent upon the materials used to form the catalytic adsorbate. Using palladium chloride and hydrochloric acid as an example of materials used to form the catalytic adsorbate, the pH preferably varies between about 1.0 and 5.5 and more preferably, between about 1.5 and 3.6. Sodium or potassium hydroxide are the preferred hydroxides. An alkali metal hydroxide is preferably added to solution in an amount necessary to provide the designated pH. The hydroxide permits reduction to take place in a relatively concentrated solution over a short period of time and it has been found that the more concentrated the solution, the more closely pH has to be regulated. These conditions favor the formation of a reduced catalytic metal of small particle size. Without careful pH control, aggregation of the reduced particles may occur in those solutions with a high concentration of catalytic metal ions. This aggregation can result in precipation of the reduced catalytic metal.

The next step in the process is the controlled reduction of the catalytic metal to reduced form in the presence of the suspending agent. It is believed that a rapid addition of reducing agent to the solution helps favor the formation of uniform particles. Rapid addition of reducing agent is defined as the addition of the reducing agent over a period of time less than 1 hour, preferably less than 30 minutes and most preferably, less than 10 minutes. This rapid addition is compared to slow addition such as drop-wise addition over a period of hours and conditions of addition may vary as production is scaled up for commercial manufacture. Associated with the rapid addition of the reducing agent is maintenance of the solution at a reduced temperature during the time that reduction takes place and the use of solution agitation. Preferably, the temperature of solution during reduction is maintained between about 0° and 20° C. and more preferably, between about 5° and 15° C. In addition to a low solution temperature, it is desirable that the reducing agent used be a weak reducing agent. Ascorbic acid and iso-ascorbic acid are examples of weak reducing agents while amine boranes and borohydrides are examples of strong reducing agents. However, strong reducing agents can be used when diluted and when reduced temperatures are employed. Hydrogen gas can be used as the reducing agent if bubbled through the solution with agitation. The hydrogen gas is preferably diluted with an inert gas such as nitrogen to reduce the rate of reaction.

During reduction, it is desirable to avoid localized areas of high concentration of reducing agent as this can result in the formation of large, unstable particulate clusters of reduced catalytic metal. Consequently, solution agitation during reduction is highly desirable. It is particularly desirable when the reducing agent used is a strong reducing agent.

The concentration of the reducing agent, relative to the catalytic metal, is dependent upon the strength of the reducing agent. Weaker reducing agents are desirably used in large stoichiometric excess of the amount required for complete reduction while the stronger reducing agents are used in approximately stoichiometric amounts. For example, ascorbic acid is preferably used in a molar ratio to catalytic metal of from 6 to 50 moles of reducing agent to 1 mole of catalytic metal and more preferably, in a molar ratio of from 15 to 25 moles of reducing agent to 1 mole of catalytic metal. The boranes, by comparison, are typically used in a ratio of about 1 to 1.

Following reduction of the catalytic metal to a reduced form, the catalytic particles are desirably inhibited or stabilized against further growth such as by the addition of a solution soluble alcohol. A wide variety of both aliphatic and aromatic hydroxyl containing organic compounds can be used for this purpose. Examples of preferred materials include ethanol, propylene glycol methyl ether and polyethylene glycol. The hydroxy compound is used in a concentration of from about 10 to 250 mls. per liter of catalytic solution and more preferably, in an amount of from 25 to 100 mls. per liter.

The alcohol is added to the solution of the catalytic adsorbate following a reasonable time interval during which reduction proceeds. The alcohol is believed to drive the reduction to completion and stabilize the catalytic adsorbate against aggregation. The time interval will vary dependent upon materials used and conditions, but on a laboratory scale, the time to add the alcohol following the addition of the reducing agent preferably varies from between 10 and 30 minutes. In commercial production, a greater time may be necessary.

The most preferred catalytic adsorbate in accordance with the invention is that formed by reduction of palladium chloride in hydrochloric acid solution in the presence of polyvinyl pyrrolidone as a suspending agent using ascorbic acid or iso-ascorbic acid as the reducing agent and propylene glycol methyl ether as the stabilizing agent.

Though the above procedure has been described in terms of reduction within an aqueous medium, the medium may be an organic inert solvent in which the catalytic metal is soluble or a water soluble organic solvent with or without admixture with water. Following formation of the adsorbate, it may be removed from the organic medium through ultracentrifugation or otherwise and redispersed in aqueous media with solution agitation to form an active catalyst of a catalytic metal of small dimension.

Though not wishing to be bound by theory, if the procedures of the invention are followed, it is believed that the dimension of the reduced catalytic metal is smallest and most uniform at the time of reduction. For the catalytic metal reduced as described above, it has been found by electron microscopy that the particles initially formed have an average dimension substantially less than 500 Angstroms, and typically, the particles become stable catalysts within a diameter range of from between 50 and 200 Angstroms. The reduced metal is itself firmly associated with the suspending agent immediately upon formation and this association, preferably coupled with the addition of the alcohol prevents aggregation of the reduced catalytic metal into larger entities with standing.

The catalytic adsorbates of this invention are characterized by the capability of catalyzing a suitably prepared substrate for metal deposition with an adsorbate having a low catalytic metal content. In this respect, though the catalytic metal content (expressed as the metal) may exceed 1,000 parts per million parts of a made-up solution ready for use, the preferred catalytic metal content in the made-up solution may vary between about 10 and 500 parts of catalytic metal per million parts of solution, and more preferably, varies from about 25 to 100 parts per million parts of solution. If the catalytic metal content in the catalyst at the time of preparation is higher than that desired for use, the catalyst may be diluted with water or a weak acid solution.

The catalytic adsorbates are preferably used in acidic solution. However, they may also be used on the alkaline side by addition of a base. In this respect, they are suitable for use at a pH up to about 13 and preferably, at a pH on the alkaline side ranging between about 10.5 and 12.5.

The catalysts of this invention may be used in a conventional manner except that a step of acceleration is not required and catalytic metal content can be significantly reduced. If a part to be plated is a non-conductor or is itself not catalytic, it is pretreated in accordance with known methods for pretreating a given non-catalytic surface. For example, parts formed from a plastic such as an acrylonitrile-butadiene-styrene copolymer (ABS) are cleaned, typically treated with a chromic acid or permanganate etchant, rinsed, neutralized to remove residual chrome or manganate, rinsed and catalyzed. This results in a pretreated plastic surface where, following catalysis with the catalytic adsorbate of the invention, electroless metal will deposit over the entire surface of the plastic typically with 100% coverage. A further improvement in the process sequence is realized by use of a conditioner of a positively charged surfactant or polymer. The conditioner is preferably used as a part of the normal pretreatment sequence as an additional step immediately preceding catalysis.

A particularly useful class of positively charged polymers that function as conditioners in the process of the subject invention are the emulsion copolymers disclosed in U.S. Pat. No. 4,359,537, incorporated herein by reference. These copolymers are formed from a major amount of a monoethylenically unsaturated monomer or mixture of monomers and a minor amount of a polyethylenically unsaturated monomer or mixtures of monomers which act to crosslink the polymer. Examples of monoethylenically unsaturated monomers include polycyclic aromatic compounds such a styrene, substituted styrenes including ethylvinylbenzene, vinyltoluene and vinylbenzyl chloride; and acrylic monomers such as the esters of methacrylic and acrylic acid including methyl acrylate, ethyl acrylate, propyl acrylate, etc. Of the acrylic esters, the preferred embodiment uses the lower aliphatic esters of acrylic acid. Suitable polyunsaturated cross-linking monomers include divinylbenzene, divinylpyridine, divinyltoluenes, ethylene glycol dimethacrylate, etc. Additional examples of each class of these materials may be found in the above referenced patent together with methods of emulsion polymerization.

The emulsion copolymers described above may be converted to positively charged ion exchange resins by methods known to the art and described in the aforementioned patent. For example, the cross linked styrene emulsion polymer may be chloromethylated with chloromethyl methyl ether in the presence of a Lewis acid such as aluminum chloride and the resulting intermediate emulsion copolymer may then be treated with a tertiary amine such as trimethylamine to form a quaternary amine chloride functional group. Alternatively, a strongly basic quaternary amine resin may be prepared by treating a cross linked acrylic ester emulsion copolymer with a diamine containing both a tertiary amine group and a primary or secondary amine group, such as dimethylaminopropylamine or di(3-dimethylaminopropyl) amine and quaternizing the resulting weakly basic resin with an alkyl halide such as methyl chloride.

Certain non cross linked polymers are also suitable for use as conditioners in accordance with this invention. These non-cross linked polymers are soluble in water and form stable, aqueous solutions. Particularly useful materials include dimethylaminoethyl methacrylate polymer, quaternized with epichlorohydrin or ethylene oxide, poly N,N-dimethyl-3,5methylene piperidinium salt, polyethylene amine, polymers of dimethyl diallyl-ammonium salt, where the salt counterion can be any soluble anion such as chloride ion; copolymers of dimethyl amine or monoethyl amine and epichlorohydrin, and quaternized forms of the above copolymers, and modified natural organic polyelectrolytes such as guar gum treated with diethylaminoethylchloride hydrochloride.

The positively charged polymers, as described above, are dissolved or dispersed in water whereby the concentration of the polymer may vary from about 0.1 to 10 percent by weight and more preferably, from about 0.5 to 5 percent by weight. The plastic part to be treated is immersed in a solution of the polymer and it adheres to the charged surface of the plastic to be treated. Thereafter, following water rinsing, the part is immersed in the solution of the catalytic adsorbate of the subject invention resulting in adsorption of the adsorbate onto the surface of the part with the formation of a firm bond between the catalytic adsorbate of the invention and the underlying plastic substrate.

With or without the treatment with the positively charged conditioner, catalysis is typically effected by immersion of a part to be plated in a solution of the catalyst at a temperature varying from room temperature to about 150° F. The time of immersion is dependent upon such factors as the concentration of catalytic metal in solution, its activity, the particular pretreatment sequence used to prepare the plastic for catalysis, temperature, etc. Preferably, the immersion time is sufficient to cause complete coverage of a part with metal within about one to three minutes immersion in the plating solution. Following immersion in the solution of the catalytic adsorbate and water rinsing, the part is immersed in the plating solution without an intermediate step of acceleration, which is unnecessary with the catalysts of this invention. Plating continues until a deposit of desired thickness is obtained.

The catalyst of the invention is useful for catalyzing substrates for deposition from those conventional electroless metal solutions known in the art. The most commonly used plating solutions are of nickel and copper. Each of said solutions comprise a source of the plating metal, a complexing agent therefor, a reducing agent, a pH adjustor and typically, a stabilizer to prevent spontaneous decomposition of the plating solution. Said solutions are well known in the art.

The invention will be better understood by the examples which follow. In the examples, for purposes of standardizing the evaluation of test samples, definitions defining functionality and stability have been adopted. One test of functionality is a backlight test. This test comprises plating a G-10 epoxy copper clad substrate having multiple through-holes using a plating sequence comprising catalysis with a test catalyst solution containing 60 parts per million parts of palladium expressed as the metal and a standardized copper plating solution. Following plating, a test coupon is prepared by cutting a piece of the plated printed circuit board using a diamond saw in a 1" by ⅛" strip with one cut going through the center of the through-holes whereby one-half of the surface of the side-wall of the holes is visible when the coupon is viewed from its edge. The coupon is placed under a microscope with the scope focused on the exposed side walls of the through-holes. The microscope used is an Olympus BHMJL scope containing a 50 watt light source and possessing a 50X magnification. Light is passed through the opposite edge of the coupon. The board is sufficiently transluscent through its ⅛ inch cross sectional dimension to permit light to pass through any voids that may be present in the electroless copper coating on the side walls. These voids would be visible under the microscope. The test described reveals voids that would be invisible to the naked eye and is considered to be a rigorous test for complete coverage.

A less rigorous test of functionality, is minimum immersion time (MIT) of a substrate in a catalytic adsorbate solution. The MIT of a catalytic adsorbate is the minimum amount of time an unclad G-10 epoxy substrate must be immersed in a catalytic adsorbate solution containing 120 parts of palladium expressed as the metal per million parts of solution to obtain 100% coverage of the substrate from an electroless copper deposition solution. For purposes of standardization and definition, a catalytic adsorbate solution providing an MIT less than or equal to one minute is considered to have passed the test while a solution with an MIT in excess of one minute is considered to have failed the test.

Stability of a catalytic adsorbate solution is defined in terms of high temperature life (HIL) of a catalyst solution prior to make-up for use. It is the time, measured in days of storage at 120° F., for the catalyst to degrade to a point where it fails the backlight test or the MIT test.

In examples 2 through 13, unless otherwise indicated, a plating sequence was used to plate G-10 epoxy printed circuit board base material as follows:

1. Clean in Cuposit® Cleaner Conditioner 1175 maintained at a temperature of from 160° to 170° F. by immersion for 5 minutes;
2. Counterflow water rinse for 2 minutes;
3. Water rinse for 2 minutes;
4. Catalyze in a catalyst adsorbate solution of the identified example by immersion at a temperature maintained at 120° F. for a time as specified in the example;
5. Water rinse for 2 minutes;
6. Plate with a freshly prepared solution of Cuposit® CP-78 electroless copper by immersion in solution maintained at 20° F. for 10 minutes;
7. Water rinse.

In the above procedure, where tradenames are used, the products are obtained from Shipley Company Inc. of Newton, Mass.

EXAMPLE 1

A first stock palladium chloride solution is prepared by adding 3 ml. of a 10% palladium chloride solution in 5% hydrochloric acid and 9.3 ml. of a 1% polyvinyl pyrrolidone solution to 153 ml of deionized water. The polyvinyl pyrrolidone used is identified as PVP K-15 and is available from GAF Corp. The polyvinyl pyrrolidone has an average molecular weight of 10,000. A second stock reducing agent solution is prepared by adding 50 grams of iso-ascorbic acid and 1.32 ml. of 50% caustic solution to 475 ml of deionized water. A third stock solution of aliphatic hydroxy compounds is prepared by adding 42 grams of nonyl phenoxy polyoxyethylene ethanol and 200 ml of propylene glycol methyl ether to 258 ml of deionized water. The three stock solutions are cooled to a temperature varying between 45° and 50° F. Sixty ml of the reducing agent second stock solution are rapidly added to the palladium chloride first stock solution to effect reduction. Reduction is evidenced by the solution rapidly turning from amber to dark black. After waiting 18 minutes, 60 ml of the alcohol third stock solution are added to the combination of the first and second stock solutions and 14.7 ml of deionized water are added to bring the total volume of catalyst to 300 ml. The resulting solution of catalytic adsorbate contains 600 parts per million parts of solution of palladium.

The above catalytic adsorbate solution was diluted with deionized water by adding one part of the adsorbate to 9 parts of water to provide an electroless plating catalyst having a palladium content of 60 parts per million parts of solution. The catalyst was used to plate a G-10 epoxy circuit board base material following the procedures described above except for step 1 where a conditioner was used other than Cuposit conditioner 1175 and a pre-etch step was added. The substitute conditioner was a 0.4 percent solution of a positively charged polyamine identified as Betz 1175 polymer (available from Betz Laboratories Inc. of Trevose, Pa.). The pH of the solution was about 10, the temperature of solution about 150° F. and the time of immersion about 5 minutes. The pre-etch step was placed between the cleaner conditioner and catalysis steps and comprised immersion in Cuposit® pre-etch 746 at a temperature of about 115° F. for two minutes. The step of pre-etching was preceded and followed by water rinsing. Thereafter, the part was catalyzed by immersion in the catalyst solution maintained at 120° F. for 5 minutes. Finally, the part was plated with electroless copper by immersion in the plating solution for 20 minutes.

Following plating, the copper plate was subjected to the backlight test and it was found that the copper deposit had about 3 or 4 microvoids on average per hole wall. This is considered to be an excellent result. For purposes of comparison, a poor result would have shown multiple voids where many of the voids would have been of larger diameter.

The stability of the catalyst was determined by storing the catalyst at 120° F. for 10 days. Prior to storage, 2 ml of propylene glycol methyl ether were added to the catalyst solution. The plating procedure was repeated and again, the catalyst passed the backlight test as only an average of from 3 to 4 voids were found in the copper plate on each of the hole walls. This means that the catalyst had a high temperature life (HTL) of at least 10 days. The test was discontinued at this point.

The procedures of Example 1 and the composition disclosed therein illustrate the most preferred embodiment of the invention.

The particle size of reduced metal associated with a suspending agent may be determined by electron microscopy using the following procedure:

a. a solution of the catalytic adsorbate is dialyzed for 3 days in dialysis tubing made of regenerated cellulose (D1615-5 Spectrapor tubing from Spectrum Medical Industries of Los Angeles, Calif.). The dialysate was distilled water changed daily;
b. the retentate remaining in the dialysis tubing is diluted by adding one part of the adsorbate to two parts of water, providing a catalytic adsorbate with 12 parts per million parts of palladium;
b. a Formvar grid is placed on a copper holder and immersed in the test solution of the catalytic retentate;
c. excess liquid is removed by blotting the edges of the copper holder with a tissue and the specimen is allowed to dry in argon gas to room temperature;
d. a photomicrograph is made of the specimen using an electron microscope with a 40 kv electron beam magnifying the particles to 80,000 X.

Using the above procedure and a catalytic adsorbate of palladium and polyvinyl pyrrolidone containing 240 ppm of palladium and free of propylene glycol methyl ether, prepared essentially following the procedures of Example 1, revealed an electron dense portion of the particles (presumed to be catalytic metal) essentially spherical in shape with diameters ranging between about 50 and 350 Angstroms.

EXAMPLES 2 THROUGH 5

The general procedures of Example 1 were repeated, though polymers other than polyvinyl pyrrolidone were substituted for polyvinyl pyrrolidone. The following sets forth components used to make the catalytic adsorbates of these examples though the order in which the components are listed is not necessarily the order in which the components were mixed together:

| | |
|---|---|
| Example 2 | |
| Deionized water | 475 ml |
| Palladium chloride (10% solution in HCl) | 1 ml |
| Ascorbic acid (10% solution) | 20 ml |
| Polyethylene glycol (0.5% solution)[1] | 4 ml |
| Example 3 | |
| Deionized water | 475 ml |
| Palladium chloride (10% solution in HCl) | 1 ml |
| Ascorbic acid (10% solution) | 20 ml |
| Polyvinyl alcohol (.5% solution)[2] | 4 ml |
| Example 4 | |
| Deionized water | 459 ml |
| Palladium chloride (10% solution in HCl) | 1 ml |
| Ascorbic acid (10% solution) | 20 ml |
| Hydroxyethyl cellulose (.1% solution)[3] | 20 ml |
| Example 5 | |
| Deionized water | 477 ml |
| Palladium chloride (10% solution in HCl) | 1 ml |
| Ascorbic acid (10% solution) | 20 ml |
| Polyacrylamide (1.0% solution)[4] | 20 ml |

[1]Polyox WSR-N-80 Union Carbide, average MW 200,000
[2]Elvanol HV, DuPont, average MW 185,000
[3]Cellosize WP-3, Union Carbide,
[4]Cyanamer P-250, American Cyanamid, MW 5 to 6 million Catalytic adsorbates were made with each of the above stock solutions following the procedures of Example 1. After formation of the catalytic adsorbate, G-10 printed circuit board base materials having through holes were plated in accordance with the procedures set forth above. All freshly prepared catalytic adsorbate suspensions used to catalyze substrates provided copper deposits with 100% coverage over the substrate. The catalytic adsorbates where then stored at 120° F. The results obtained are as follows:

| Example No. | HTL (days) |
|---|---|
| 2 | >23 |
| 3 | >66 |
| 4 | >37 |
| 5 | 18 |

EXAMPLE 6

Example 5 was repeated substituting 215 ml. of a 0.01% sodium borohydride solution for the ascorbic acid solution and 20 ml of a 10% aqueous solution of polyoxyethylene (20) sorbitan monooleate (Tween 80 from ICI Americas, Inc.) for the polyacrylamide solution. A catalyst with an HIL of 26 days was obtained.

EXAMPLES 7 TO 10

The general procedures of Example 1 were repeated, though reducing agents other than ascorbic acid were substituted for the ascorbic acid. The following sets forth components of the catalytic adsorbates of these examples though the order in which the components are listed is not necessarily the order in which the components were mixed together:

| | |
|---|---|
| Example 7 | |
| Deionized water | 479 ml |
| Palladium chloride (10% solution in HCl) | 1 ml |
| Formaldehyde (18.5% solution) | 20 ml |
| Polyvinyl pyrrolidone (10% solution) | 0.2 ml |
| Example 8 | |
| Deionized water | 479 ml |
| Palladium chloride (10% solution in HCl) | 1 ml |
| Hypophosphorus acid[1] | 20 ml |
| Polyvinyl pyrrolidone | 2.1 gm |
| Example 9 | |
| Deionized water | 479 ml |
| Palladium chloride (10% solution in HCl) | 1 ml |
| Dimethylamine borane (0.014% solution) | 215 ml |
| Polyvinyl pyrrolidone | 2.1 gm |
| Example 10 | |
| Deionized water | 479 ml |
| Palladium chloride (10% solution in HCl) | 1 ml |
| Formic acid (10% solution) | 20 ml |
| Polyvinyl pyrrolidone (10% solution) | 0.21 ml |

[1]89 ml of deionized water, 21 gm of 97.6% hypophosphorus acid and 11 ml of 50% sodium hydroxide.

Catalytic adsorbates were made with each of the above stock solutions following the procedures of Example 1. After formation of the catalytic adsorbate, G-10 printed circuit board base materials having through holes were plated in accordance with the procedures set forth above. All freshly prepared catalytic adsorbate suspensions used to catalyze substrates provided copper deposits with 100% coverage over the substrate. The catalytic adsorbates where then stored at 120? F. for a time whereby the MIT for the test catalyst was reduced to 1 minute. The results obtained are as follows:

| Example No. | HTL (days) |
|---|---|
| 7 | >90 |
| 8 | >90 |
| 9 | 15 |
| 10 | 26 |

EXAMPLES 13 THROUGH 13

The polyacrylamide formulation of Example 5 was used to make catalytic adsorbates following the procedures of Example 1, but other reducing agents were substituted for ascorbic acid. The following sets forth components of the catalytic adsorbates of these examples though the order in which the components are listed is not necessarily the order in which the components were mixed together:

| | |
|---|---|
| Example 11 | |
| Deionized water | 282 ml |
| Palladium chloride (10% solution in HCl) | 1 ml |
| Sodium borohydride (0.01% solution) | 215 ml |
| Polyacrylamide (1.0% solution) | 2 ml |
| Example 12 | |
| Deionized water | 282 ml |

-continued

| | |
|---|---|
| Palladium chloride (10% solution in HCl) | 1 ml |
| Sodium hypophosphite (0.03% solution) | 215 ml |
| Polyacrylamide (1.0% solution) | 2 ml |
| Example 13 | |
| Deionized water | 477 ml |
| Palladium chloride (10% solution in HCl) | 1 ml |
| Hypophosphorus Acid[1] | 215 ml |
| Polyacrylamide (1.0% solution) | 2 ml |

[1]Solution of 89 ml of deionized water, 21 gm of 97.6% hypophosphorus acid and 11 ml of 50% sodium hydroxide.

Catalytic adsorbates were made with each of the above stock solutions following the procedures of Example 1. After formation of the catalytic adsorbate, G-10 printed circuit board base materials having through holes were plated in accordance with the procedures set forth above. All freshly prepared catalytic adsorbate suspensions used to catalyze substrates provided copper deposits with 100% coverage over the substrate. The catalytic adsorbates where then stored at 120° F. The results obtained are as follows:

| Example No. | HTL (days) |
|---|---|
| 11 | >62 |
| 12 | >62 |
| 13 | >62 |

EXAMPLE 14

The procedure of Example 1 was repeated using a plating process with an alkaline polymeric conditioner substituted for conditioner 1175. The conditioner is believed to be a styrene divinylbenzene emulsion copolymer aminated with polyethylene imine. It is believed to be a positively charged tertiary amine. The results obtained were approximately the same as the results obtained for Example 1.

The catalyst of this invention can be used in a spray mode whereby a fine spray of catalyst is directed onto a surface to be plated. In contrast, the prior art tin-palladium catalysts could not be economically used in a spray mode because spraying would result in excessive oxidation of tin and instability of the catalyst. The catalysts of the subject invention are not as oxidation sensitive and remain stable after continuous use in the spray mode.

In addition to the use of the catalytic adsorbate of the invention in a spray mode, it may be dried to a free flowing powder for shipment and stability, and then readily redispersed in aqueous solution when ready for use. In this respect, the catalytic adsorbate is readily redispersed in aqueous solution by simple agitation.

The catalytic adsorbates of the invention are particularly suitable for the manufacture of plated through-hole printed circuit boards and through hole multi-layer printed circuit boards. After plating through-holes in the manner set forth in Example 1, a circuit board may be plated with copper either electrolytically with superior copper to copper bonds obtained or may be plated with copper electrolessly to full conductor thickness for additive board manufacture.

There are several new methods for the manufacture of additive printed circuit boards made possible, at least in part, by the new catalytic adsorbates of the subject invention. One method comprises preparation of an unclad circuit board base material for plating, including the steps of drilling through-holes where appropriate followed by catalysis with the catalytic adsorbates of the invention. Thereafter, a suitable screen ink is screened onto the circuit board base material in a negative pattern of the desired circuit and cured. Copper is then plated over the exposed portions of the boards (not coated with the screen ink) and in the through-holes to full desired thickeness to provide an additive printed circuit board. The procedure is made possible because the catalytic adsorbate solutions of the invention do not attack the surface insulation resistance of the circuit board base material.

An additional method for making an additive board is based upon the ability to selectively strip adsorbed catalytic adsorbates from a circuit board base material. By this method, an unclad circuit board base material is prepared for plating in conventional manner including the drilling of through-holes. The board material is then uniformly roughened to increase its surface area. This can be accomplished either chemically or mechanically such as by sanding. The circuit board base material is then printed in a negative of a printed circuit pattern using any known printing or screen ink designed for this purpose. The board bearing the ink image is then catalyzed with the catalytic adsorbate solution of the invention. The catalytic adsorbate adsorbs to a greater extent on the roughened portions of the circuit board base material than on the smooth ink surfaces. Following catalysis, the board is treated with a stripping solution such as a sulfuric acid solution containing a nitrate salt. Since there is greater adsorption of catalytic adsorbate on the roughened portion of the board than on the smoother ink, the catalytic adsorbate may be completely stripped from the ink while being retained on the roughened portion of the board. Thereafter, copper can be selectively plated onto the roughened portions of the board catalyzed with retained catalytic adsorbate.

For decorative applications, any number of coatings may be applied to an electroless deposit obtained in accordance with the process of the invention. For example, electroless nickel or electrolytic copper, nickel, chromium, in that sequence, may be applied over electroless copper plated in accordance with the invention.

We claim:

1. A functional catalytic adsorbate for electroless metal deposition consisting essentially of a reduced platinum family metal fixedly associated with an organic suspending agent, where the reduced platinum family metal is characterized by an average maximum dimension not exceeding 500 Angstroms, said catalytic adsorbate being suspended in an aqueous medium consisting essentially of water.

2. The adsorbate of claim 1 where the reduced platinum family metal is palladium.

3. The adsorbate of claim 2 where the adsorbate is suspended in an aqueous medium having a pH not exceeding 5.5.

4. The adsorbate of claim 2 where the adsorbate is suspended in an aqueous medium having a pH of at least 8.0.

5. The adsorbate of claim 3 where pH of the aqueous medium varies between 1.5 and 3.6.

6. The adsorbate of claim 2 the average maximum dimension of the reduced palladium does not exceed 300 Angstroms.

7. The adsorbate of claim 2 where the concentration of reduced palladium varies between 10 and 2,000 parts per million parts of solution.

8. The adsorbate of claim 7 where the concentration varies between 300 and 1,500 parts per million parts of solution.

9. The adsorbate of claim 2 where the organic suspending agent is a water soluble or dispersible organic polymer.

10. The adsorbate of claim 9 where the polymer is selected from the group of alkyl and hydroxyalkyl celluloses, polyacrylamides, polyethylene glycol, polyvinyl alcohol, polyvinyl pyrrolidone and surfactants with polymer adducts.

11. The adsorbate of claim 10 where the polymer is polyvinyl pyrrolidone.

12. The adsorbate of claim 10 where the concentration of the polymer in solution varies between 10 and 100,000 parts per million parts of solution.

13. The adsorbate of claim 12 where the concentration varies between 20 and 10,000 parts per million parts of solution.

14. A functional catalytic adsorbate for electroless metal deposition consisting essentially of reduced palladium adsorbed onto an organic polymeric suspending agent, where the reduced palladium is characterized by an average maximum dimension not exceeding about 500 Angstroms, said catalytic adsorbate being suspended in an aqueous medium consisting essentially of water having a pH not exceeding 5.5.

15. The adsorbate of claim 14 where pH varies between 1.5 and 3.6 or 10.5 and 13.0.

16. The adsorbate of claim 14 where the average maximum dimension of the reduced palladium does not exceed 300 Angstroms.

17. The adsorbate of claim 14 where the concentration of reduced palladium varies between 10 and 2,000 parts per million parts of solution.

18. The adsorbate of claim 14 diluted with water whereby the palladium content varies between 10 and 200 parts per million parts of solution.

19. The adsorbate of claim 14 where the polymer suspending agent is selected from the group of alkyl and hydroxyalkyl celluloses, polyacrylamides, polyethylene glycol, polyvinyl alcohol, polyvinyl pyrrolidone and surfactants with polymer adducts.

20. The adsorbate of claim 19 where the polymer is polyvinyl pyrrolidone.

21. The adsorbate of claim 19 where the concentration of the polymer in solution varies between 10 and 100,000 parts per million parts of solution.

22. The adsorbate of claim 21 where the concentration varies between 20 and 10,000 parts per million parts of solution.

23. A functional catalytic adsorbate for electroless metal deposition consisting essentially of reduced palladium adsorbed onto polyvinyl pyrrolidone, where the reduced palladium is characterized by an average maximum dimension not exceeding 500 Angstroms, said catalytic adsorbate being suspended in an aqueous medium consisting essentially of water having a pH not exceeding 5.5 and a palladium concentration varying between 10 and 2,000 parts per million parts of solution.

24. The adsorbate of claim 23 where the average maximum dimension of the reduced palladium does not exceed 300 Angstroms.

25. The adsorbate of claim 23 diluted with water whereby the palladium content varies between 10 and 200 parts per million parts of solution.

26. The adsorbate of claim 23 as a dried redispersible product.

27. The adsorbate of claim 23 where the concentration of the polyvinyl pyrrolidone varies between 10 and 100,000 parts per million parts of solution.

28. The absorbate of claim 27 where the concentration varies between 20 and 10,000 parts per million parts of solution.

* * * * *